US005684879A

United States Patent [19]

Verdick

[11] Patent Number: 5,684,879

[45] Date of Patent: Nov. 4, 1997

[54] COMBINATION HEAD MOUNTED SPEAKER ASSEMBLY AND MULTI-CHANNEL AUDIO PROCESSING SYSTEM

[76] Inventor: Michael Verdick, 1216 E. Glenoaks Blvd., #1, Glendale, Calif. 91206

[21] Appl. No.: 588,932

[22] Filed: Jan. 19, 1996

[51] Int. Cl.[6] ..... H04R 5/00

[52] U.S. Cl. ..... 381/24; 381/183; 381/187

[58] Field of Search ..... 381/183, 187, 381/24, 102, 103, 90; 181/144, 145

[56] References Cited

U.S. PATENT DOCUMENTS

| | | | |
|---|---|---|---|
| D. 351,622 | 10/1994 | Holmes | D21/240 |
| 3,384,719 | 5/1968 | Lanzara | 179/146 |
| 3,621,155 | 11/1971 | Pruitt | 179/146 H |
| 3,984,636 | 10/1976 | Turner | 179/1 GQ |
| 4,075,438 | 2/1978 | Kappel | 179/146 H |
| 4,107,461 | 8/1978 | Bose | 179/1 GA |
| 4,124,249 | 11/1978 | Abbeloos | 297/217 |
| 5,105,462 | 4/1992 | Lowe | 381/17 |
| 5,199,075 | 3/1993 | Fosgate | 381/24 |
| 5,301,237 | 4/1994 | Fosgate | 381/89 |
| 5,406,037 | 4/1995 | Nageno et al. | 181/129 |
| 5,497,425 | 3/1996 | Rapoport | 381/18 |
| 5,574,795 | 11/1996 | Seki | 381/183 |

FOREIGN PATENT DOCUMENTS

| | | | |
|---|---|---|---|
| 0287409 | 9/1913 | Germany | 381/187 |
| 0883002 | 7/1953 | Germany | 381/183 |

*Primary Examiner*—Curtis Kuntz
*Assistant Examiner*—Rexford N. Barnie

[57] ABSTRACT

A combination head mounted speaker assembly and multi-channel audio processing system includes a pair of speaker assemblies mounted at the ends of a pair of extension arms. The arms are mounted on a headband worn on a user's head, so that the speakers in the assemblies are suspended several inches away from either side of the head. The speaker assemblies are also spaced above the shoulders so that the user can maintain the ability to turn his or her head. The speakers arc connected via a cable to an eight channel audio processing system, which can deliver eight discreet audio sources into each of the eight speakers, four on each side of the head.

12 Claims, 8 Drawing Sheets

COMBINATION HEAD MOUNTED SPEAKER ASSEMBLY AND MULTI-CHANNEL AUDIO PROCESSING SYSTEM

BACKGROUND OF INVENTION

The field of this invention is audio speakers, and, more particularly, head mounted high fidelity speakers for reproducing multi-channel recorded material in combination with a multi-channel audio processing system. Audio speakers have been used since the advent of the radio. With the advent of stereo sound many audio speakers have been sold as separate components mounted in boxes which can be placed in desired locations in a room.

Current surround sound systems require the use of four to six speakers placed within a room to achieve an even more realistic environment. As the number of simultaneous but discrete sound sources increase, the surround sound quality becomes more realistic but it also becomes more difficult to place speakers in a room so that they blend in with the room's decor. In addition, the optimum listening area becomes more focused and therefore, it becomes more difficult for multiple listeners to experience the optimal surround sound experience.

The shape and the acoustic quality of the room also become critical factors as the number of sound sources increase. Hard wall, ceiling and floor surfaces cause sound to bounce in counter productive directions, and furniture pieces create unwanted sound barriers and reflectors. These conditions result in a nonlinear frequency response and unpleasant reverberations following the normal audio decay. Furthermore, to obtain the maximum quality of realism in sound delivery, it is necessary to listen to the audio performance at a relatively high volume thereby making it unpleasant for those in the room who do not wish to participate in the room filled audio experience.

Stereo headphones which exist currently do not produce a surround sound effect with the depth or precise localization of discreet speaker systems. The use of 3D processing to achieve exact height and side localization for multiple sound sources is neither as consistent nor as effective as discreet sound placement. The listener must not be off axis between the two speakers to get the full effect, and, the effect can also be diminished when sound sources contain or are referenced to phase modulated sounds similar to the effect itself, and particularly when said sounds are in moving panning situations.

Additionally, headphones tend to eventually produce irritating ear pressure due to the mating relationship of the headphones to the listener's ears. A conversation between multiple listeners is nearly impossible when using headphones because of the sound isolation caused by the mating relationship of the headphones to the listener's ears.

Some quadraphonic headphones exist which have two speakers on each ear, but because of the very close proximity of ear audio transducer to the listener's ear, the optimal surround sound experience is not available.

Another attempt to create a realistic surround sound experience involves the placement of speakers in the side wings of a high backed chair or on a stand so that the speakers are near a person's ears while sitting in a low backed chair. In both cases the surround sound experience is impaired if the listener turns his or her head or in any way deviates from the optimal listening position. Additionally, current surround sound systems lack the realism needed for future multi media and virtual reality mediums because the sound reproduction process has no height designations. To achieve proper height localization with speaker systems it would require nearly twice the number of speakers in a room devoid of any objects in direct line with the speaker transmission paths, and a simple chair without much mass to block transmissions for a single listener playback system. Besides being very impractical on a social and marketing level, all of the room and furniture interference problems described above would be compounded.

SUMMARY OF THE INVENTION

It is an object of this invention to provide a head mounted speaker assembly and associated multi-channel audio processing system allowing a person or persons to have a multi-channel realistic surround sound experience without having to place many speakers around a room. Another object of the present invention is to provide a head mounted speaker assembly where the listener can have a surround sound experience in any room that permits the setup of the system's equipment. Another object of the present invention is to provide a head mounted speaker assembly where a room's size, acoustics and furniture layout do not greatly affect the response of the audio playback or surround sound experience. It is a further object of this invention to provide a head mounted speaker assembly in which unwanted over spilling sound volume in the vicinity of the listener is kept to a minimum.

Another object of the present invention is to provide a head mounted speaker assembly where the speakers are suspended close but not touching the user's ears thereby reducing ear fatigue. Another object of this invention is to provide a head mounted speaker assembly which is held on a person's head by an easily adjustable headband. Another object of this invention is to provide a head mounted speaker assembly whose speakers are mounted on a support member attached to a headband so that the user can turn his or her head freely while the suspended speakers maintain their correct orientation with respect to the listener's ears. Another object of the present invention is to provide speaker assemblies which can be connected to a single audio source so that a number of individuals can experience the same high quality surround sound while sitting in their choice locations. Another object of the present invention is to provide the opportunity of conversation between multiple listeners while they each experience optimum positioning within a high quality surround sound experience. Another object of the present invention is to provide a head mounted speaker assembly connected to an associated multi-channel processing/mixing device which allows the user to connect his or her sound source, from two to eight channels to achieve the highest quality surround sound. Another object of this invention to provide a head mounted speaker assembly and associated multi-channel audio processing system providing discreet sound positioning for side and height localization. The resulting sound can approximate realistic situations giving the impression of sounds emanating from a high, low, left, right, front or rear orientation making it ideal for multi media and virtual reality applications.

Accordingly, the present invention accomplishes the above objectives by mounting a plurality of small speakers in close relation to, but not touching the user's head or ears. The speakers are suspended four to seven inches on either side of the user's head and held in place by extension arms which are attached to a light weight head band assembly. The lower portion of the speaker assemblies are positioned above the shoulder level so that the listener can maintain the ability to turn his or her head. The speakers are connected via multi wire cable to a special eight channel audio processing system which can deliver as many as eight discreet audio sources into each of the eight speakers, four on one side of the user's head and four on the other side. The audio processing unit can also process and deliver fewer audio signals such as normal stereo (two sources) or quadraphonic (four sources).

Audio processing systems which handle more than eight channels are also possible however, in the preferred embodiment described below, eight channels are discussed.

DETAILED DESCRIPTION OF THE PREFERRED EMBODIMENT

Figure 1:
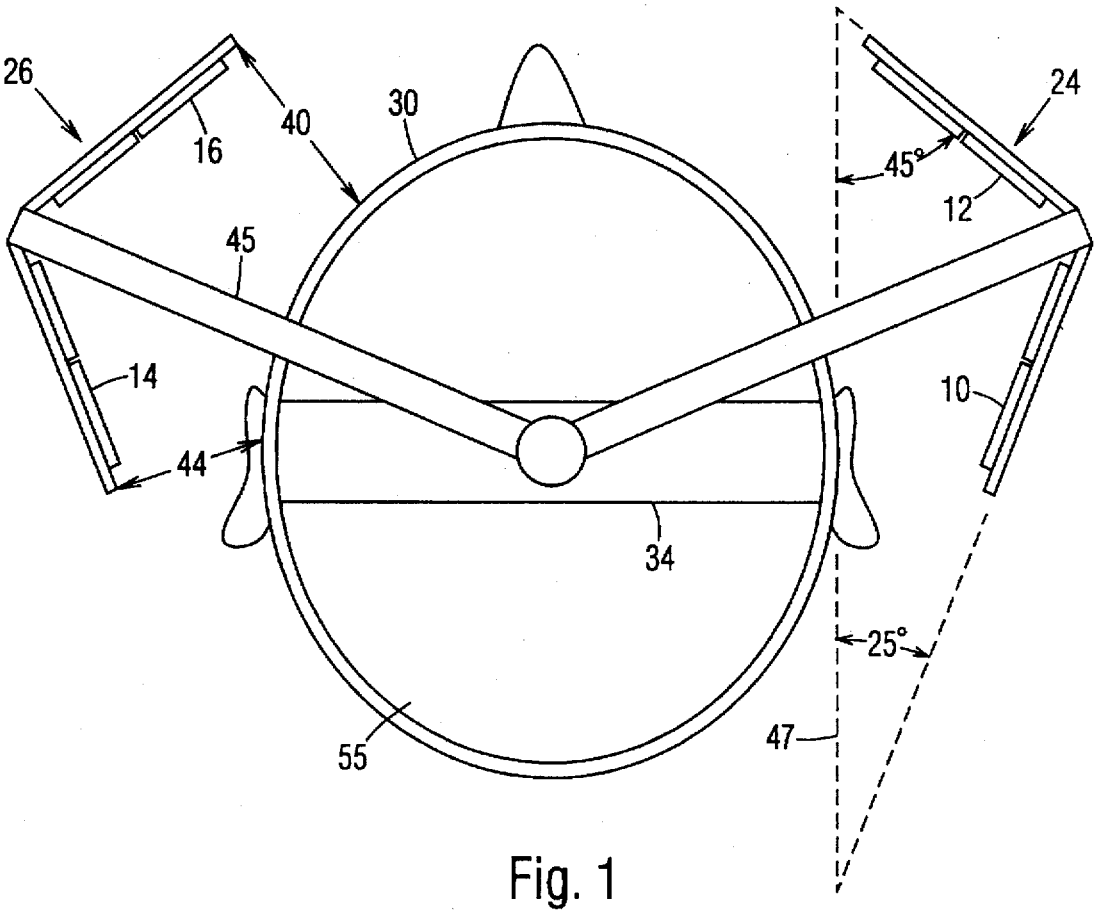
FIG. 1 is a top view of the present invention.

FIG. 1 shows the head mounted speaker assembly of the present invention mounted on a person's head 55. Strap 30 wraps around the temple and rear of head forming a headband 30. Over the head strap 34 extends from one side of headband 30, near the right ear, to the other side of headband 30, near the left ear. Extension arm 45 attaches to the top center portion of head strap 45. Speaker assemblies 24 & 26 attach at their top most point to either end of extension arm 45. Speakers 16 & 12 are positioned at a 45 degree angle with respect to the side of the user's head 47. Rear speakers 10 & 14 are positioned at a 25 degree angle with respect to the side of the user's head 47. The distance 40 between the leading edge of speakers 12 & 16 and the user's head is approximately four and one half inches. The distance 44 between the trailing edge of the rear speakers and the user's head is approximately seven inches.

Figure 2:
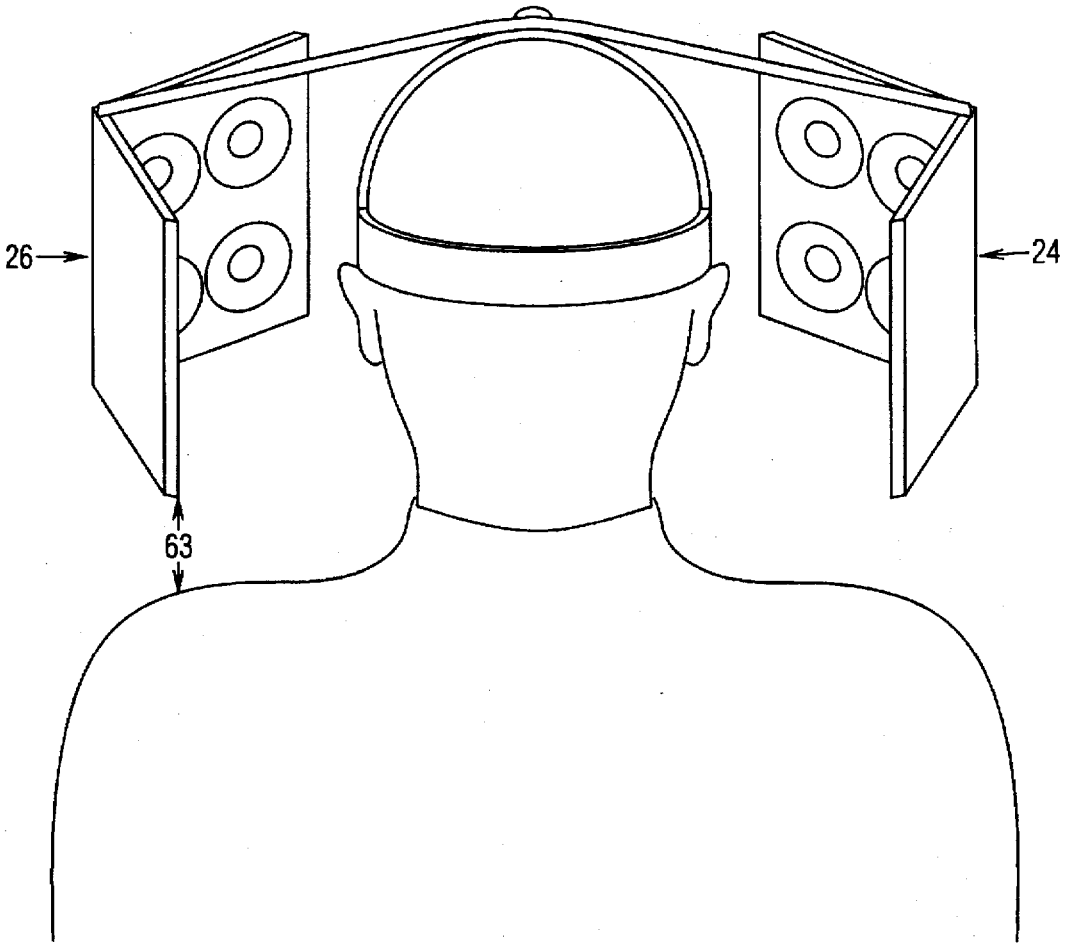
FIG. 2 is a rear view of the present invention.

FIG. 2 shows a rear view of a person wearing the present invention. The lower edge of speaker assemblies 24 & 26 are at least two inches 63 above the top of the user's shoulder.

Figure 3:
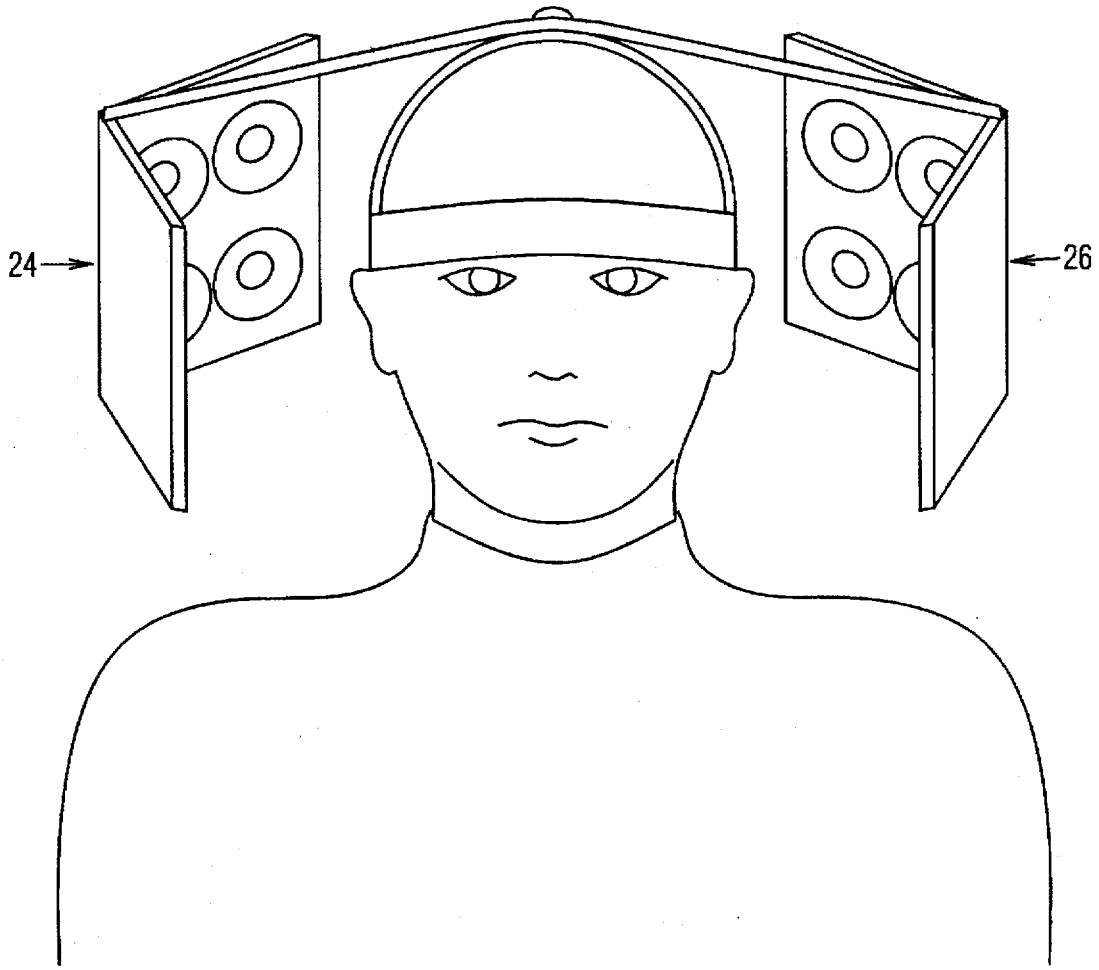
FIG. 3 is a front view of the present invention.

FIG. 3 is a front view of a person wearing the head mounted speaker of the present invention showing that speaker assemblies 24 & 26 do not interfere with forward vision associated with viewing a television or other visual display.

Figure 4:
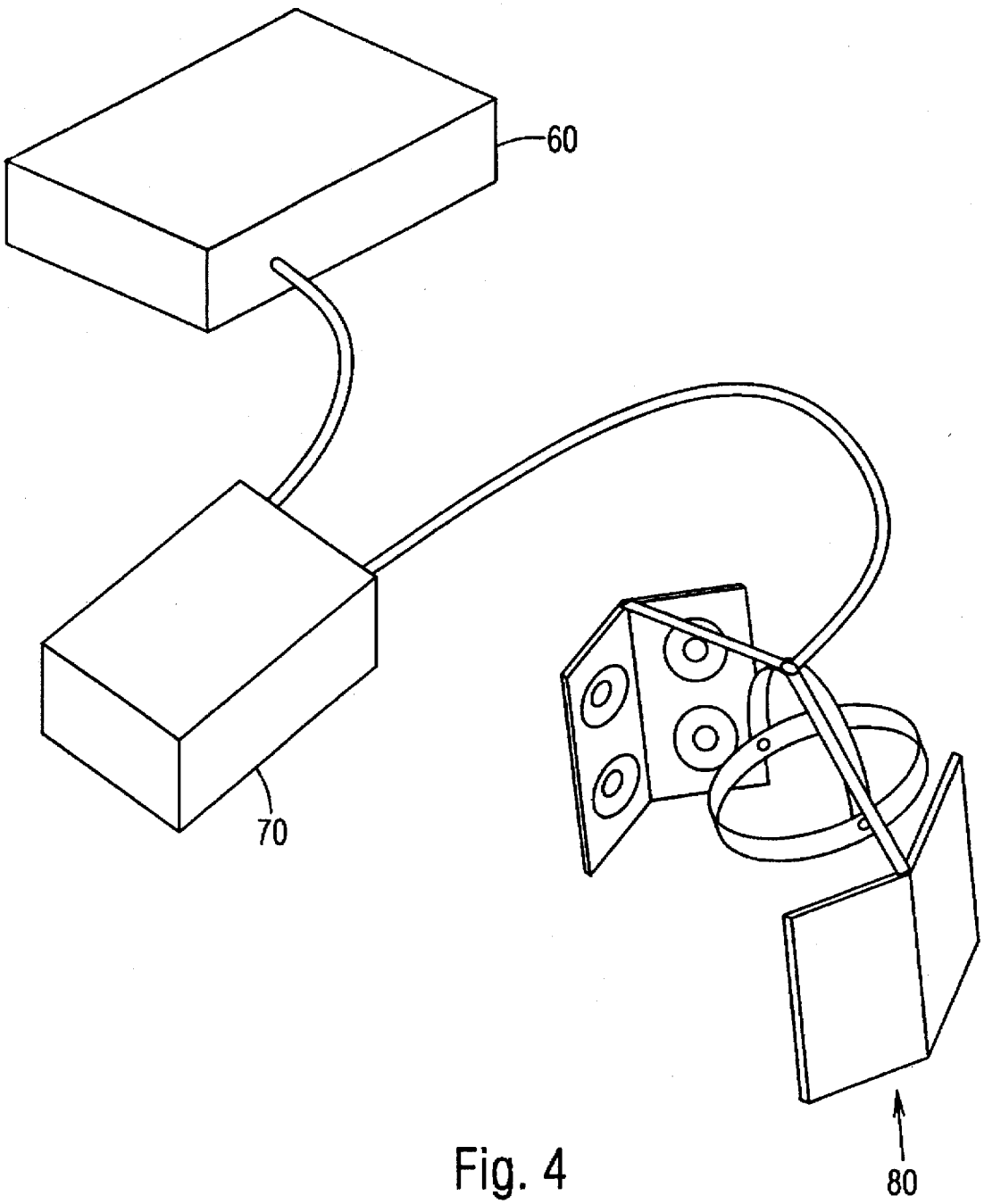
FIG. 4 is a perspective view showing the head mounted speaker assembly of the present invention connected to the multi-channel processing section of the present invention.

FIG. 4 shows the entire head mounted speaker assembly 80 attached to a multi wire cable to a multi-channel processor 70. Audio signals originate from the user's audio source 60 such as a home stereo, quadraphonic or eight channel source.

Figure 5:
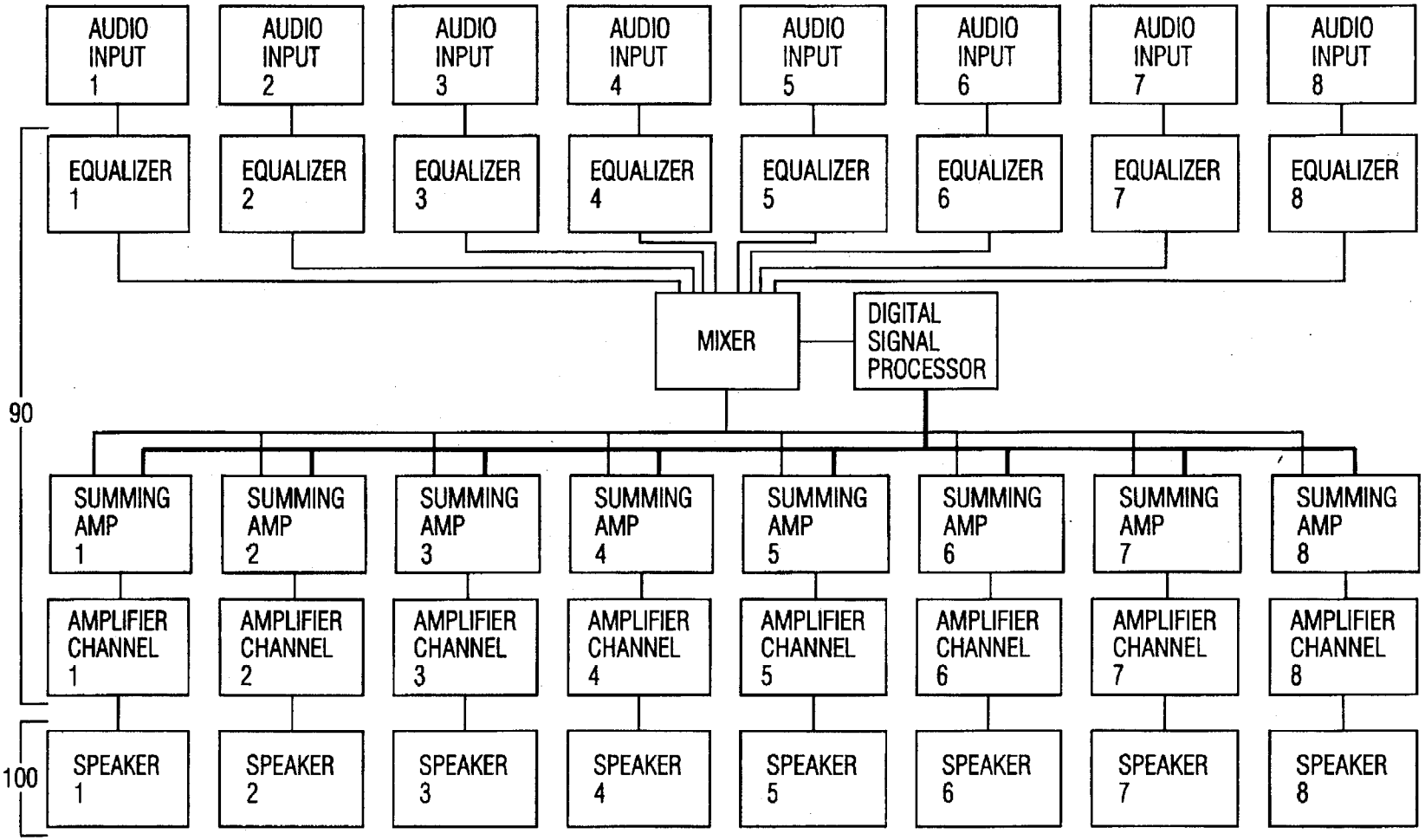
FIG. 5 is a block diagram of the multi-channel signal processor of the present invention.

FIG. 5 shows a block diagram of an eight channel processing unit 90. Audio signals are fed out to speakers 100. The current embodiment shows eight channels feeding eight speakers. Stereo input would be fed into channels 1 & 2. Quadraphonic input would be fed into channels 1,2,3 & 4. Eight spherical imaging audio inputs would be fed into all eight channels. Even more channels such as 10, 12 or more are possible.

Each "Audio Input" stage is routed to the correspondingly numbered "Equalizer" stage. The Equalizer's function is to enhance the tonal quality of the input signal by expanding the extreme lower and upper regions creating a bigger and clearer sound. This also reduces the need for larger speakers to produce the same effect. The "Equalizer" design is known in the art for boost only, with two bands, low frequency (100 Hz) and high frequency (12.5K). Signals are next routed to the "Mixer".

The Mixer's function is to control gain levels, invert a signal's phase (when required) and make assignments to the "Summing Amps" and the "Digital Signal Processor" . The "Mixer" contains sixteen Input Channels and sixteen Bus Outputs. The "Equalizer" outputs are each routed to two input channels. Equalizer One routes to Input Channels One and Nine, Equalizer Two to Two and Ten and so on.

Figure 6:
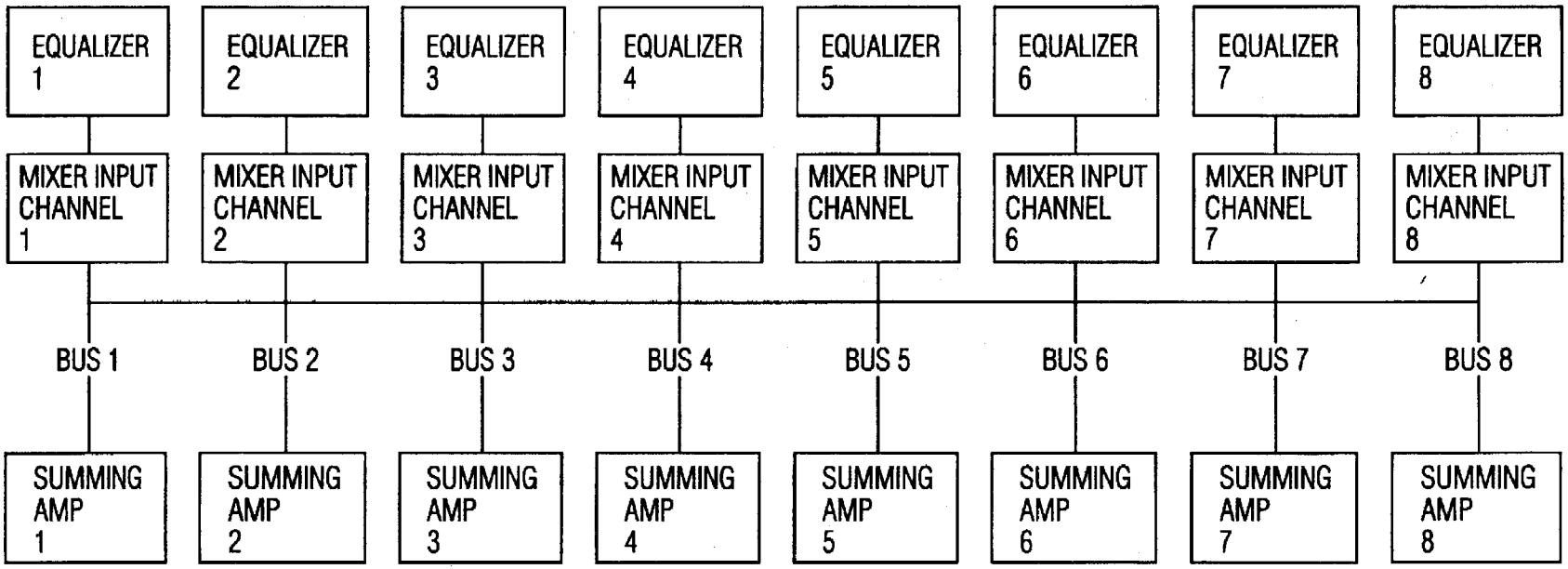
FIG. 6 is a block diagram of buss 1 through 8 of the signal processor of the present invention.
Figure 7:
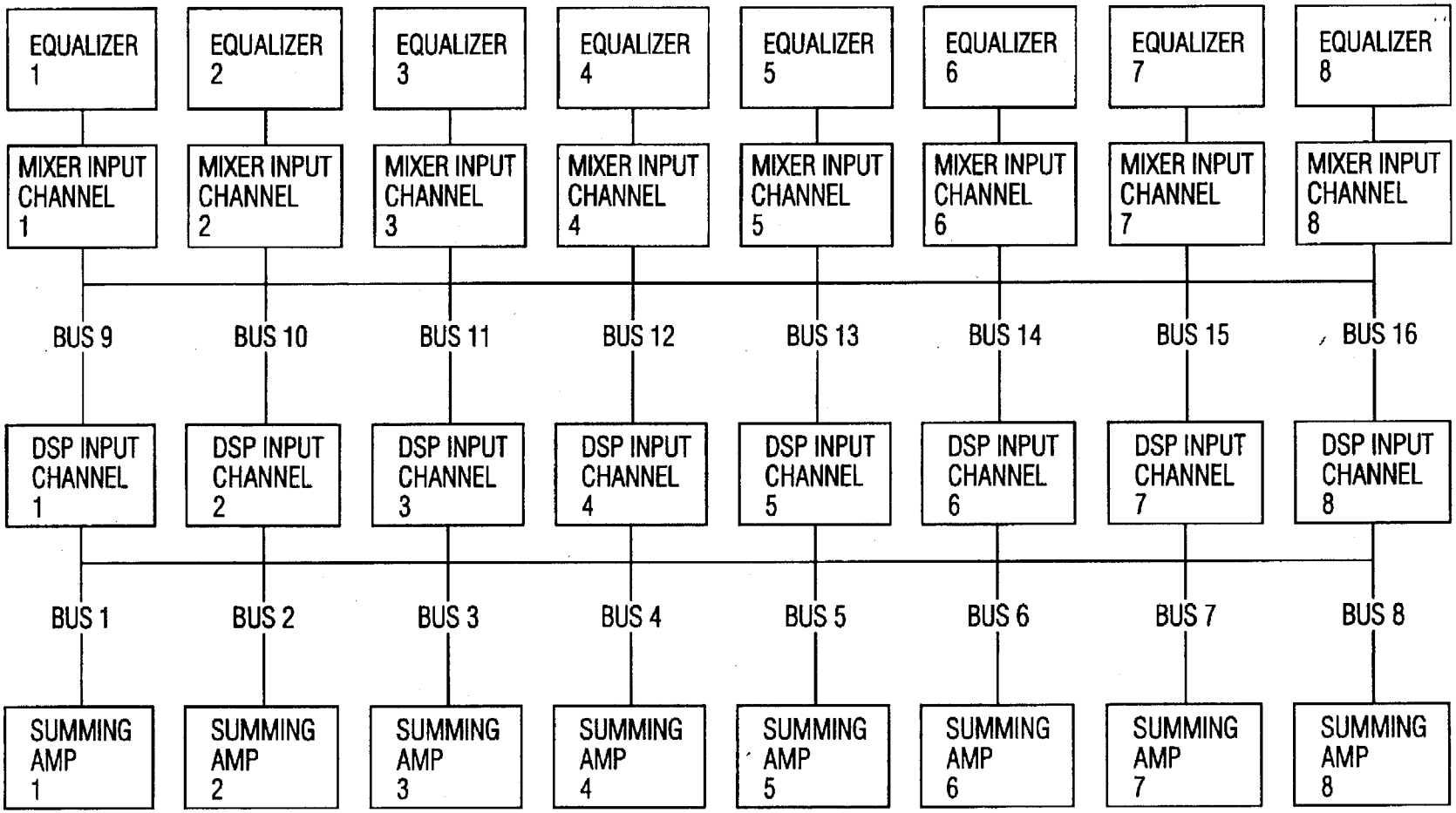
FIG. 7 is a block diagram of buss 9 through 24 of the multi-channel processor of the present invention.

Referring to FIG. 6 the Input Channels and Buses One through Eight are for processing and assignment to the "Summing Amps", with Bus One routing to Summing Amp One and so on. Referring to FIG. 7, the Input Channels and Buses Nine though Sixteen are for processing and assignment to the "Digital Signal Processor", with Bus Nine routing to Digital Signal Processor Input one, and so on.

The purpose of this arrangement is allow the "Summing Amps" and the "Digital Signal Processor" to receive (the potential of) independent signals of varying phase and level from the "Mixer".

The "Digital Signal Processor" can provide several signal modification options. These include pitch alteration, modulation, flanging, delay, chorus, reverb, room simulations, as well as combinations of each. These processing effects help to produce spatial dimension within the head mounted speaker assembly.

Referring now to FIG. 7, the "Digital Signal Processor" has eight input channels and eight buss outputs (labeled One through Eight). These busses with Mixer Busses One through Eight are routed to the "Summing Amps".

The "Summing Amps" mix buss signals from the "Mixer" and the "Digital Signal Processor" to a single output, which is routed to the similarly numbered "Amplifier Channel".

The "Amplifier Channel" raises the gain from the "Summing Amps" so that it will drive the speakers, and is routed to the correspondingly numbered "Speaker".

Figure 8:
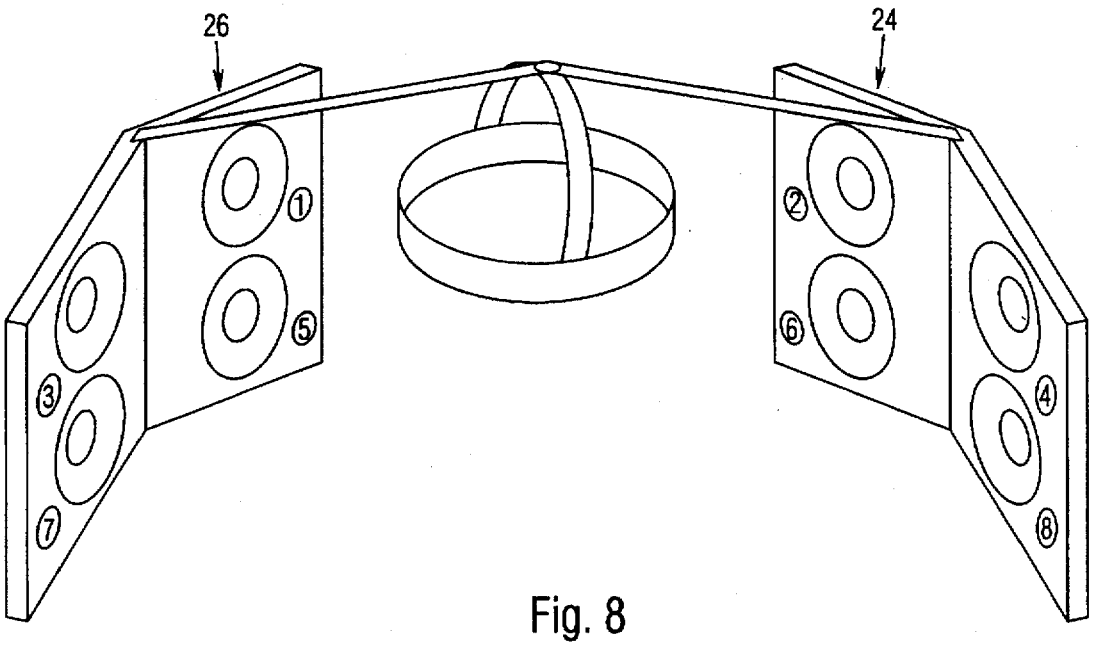
FIG. 8 is a perspective view of the present invention showing the location of the speakers.

FIG. 8 is a rear perspective view of the present invention. Output speakers in speaker assemblies 24 & 26 are numbered. "1" is for the upper left, front sound. "2" is for the upper right, front sound. "3" is for the upper left, rear sound. "4" is for the upper right, rear sound. "5" is for the lower left, front sound. "6" is for the lower right, front sound. "7" is for the lower left, rear sound. "8" is for the lower right, rear sound.

Each speaker 50 is between two and four inches in diameter.

I claim:

1. A head mounted speaker assembly in combination with a multi-channel audio processing system, comprising:

a resilient non-elastic strip forming a circular band;

a second resilient non-elastic strip with a first end center point on said band and arching in a semicircular fashion, and a second end attached to an opposing center point on an opposite side of said circular band;

an extension arm attached centrally to an apex of the second strip and extending horizontally in opposite directions;

a pair of downwardly disposed speaker support assemblies attached to opposite ends of said extension arm, each of the speaker support assemblies being positioned 90 degrees with relation to said extension arm; and a plurality of speakers attached to each of the speaker support assemblies, said speakers including front and rear speakers, a plurality of the front speakers are vertically mounted on top of one another in a position forward of a listener's ear at approximately a 45 degree inwardly facing angle with relation to said listener's head, and a plurality of the rear speakers are vertically mounted on top of one another in a position to the rear of said listener's ear at approximately a 25 degree inwardly facing angle in relation to said listener's head, the from speakers are positioned approximately four and one half inches from said listener's ear, and the rear speakers are positioned approximately seven inches from said listener's ear, the bottom edge of each of the speaker support assemblies being suspended at least two inches above said listener's shoulders.

2. A head mounted speaker assembly in combination with a multi-channel audio processing system as claimed in claim 1 wherein said multi-channel audio processing system processes at least eight channels of audio input, each of said channels being equalized, processed, mixed and amplified and fed to each of said speakers.

3. A head mounted speaker assembly in combination with a multi-channel audio processing system as claimed in claim 1 wherein said audio processing system sends audio signals to a plurality of said speakers, so that a resulting sound emanating from the speakers creates a realistic simulation of an environment where sound sources are located above, below, central, left, right, in front, in the rear, or any combination thereof.

4. A head mounted speaker assembly in combination with a multi-channel audio processing system as claimed in claim 1 wherein said head mounted speaker assembly is constructed of light weight and rigid materials.

5. A head mounted speaker assembly in combination with a multi-channel audio processing system as claimed in claim 1 wherein amplification of an audio signal and resulting sound is minimized due to said speakers'proximity to said listener's ears.

6. A head mounted speaker assembly in combination with a multi-channel audio processing system as claimed in claim 1 wherein a sound emanating from said speakers is aimed directly at said listener's ears, thereby eliminating interference due to sound bouncing off a ceiling, walls, floors and objects of a listener's room.

7. A head mounted speaker assembly in combination with a multi-channel audio processing system as claimed in claim 1 wherein a plurality of listeners can each wear said head mounted speaker assembly, each of which is plugged into the same multi-channel audio processing system, thereby giving each listener an optimal listening experience.

8. A head mounted speaker assembly in combination with a multi-channel audio processing system as claimed in claim 1 wherein said listener may turn his or her head without interference from the head mounted speaker assembly.

9. A head mounted speaker assembly in combination with a multi-channel audio processing system as claimed in claim 1 wherein said listener may turn his or her head and yet sound distribution is maintained regardless of the listener's head position while wearing said head mounted speaker assembly.

10. A head mounted speaker assembly in combination with a multi-channel audio processing system as claimed in claim 1 wherein two audio channels, four audio channels, eight audio channels, or a plurality of channels can be mixed to produce a surround sound experience since a plurality of channels create a realistic surround sound listening experience.

11. A head mounted speaker assembly in combination with a multi-channel audio processing system as claimed in claim 1 which eliminates a need to place multiple speaker enclosures and accompanying wiring in a room thereby enabling a user to put furniture in a desired location.

12. A head mounted speaker assembly in combination with a multi-channel audio processing system as claimed in claim 1 wherein said multi-channel audio processing system sends audio signals in a discreet fashion to a plurality of said speakers, so that a resulting sound emanating from said speakers creates a realistic localization of sound from a height perspective.

* * * * *